US008122976B2

(12) United States Patent
Bartette et al.

(10) Patent No.: US 8,122,976 B2
(45) Date of Patent: Feb. 28, 2012

(54) VALVE, CORE SAMPLING APPARATUS AND METHOD

(75) Inventors: Pascal Bartette, Dubai (AE); Philippe Cravatte, Aberdeen (GB)

(73) Assignee: Corpo Systems Limited, Aberdeenshire (GB)

( * ) Notice: Subject to any disclaimer, the term of this patent is extended or adjusted under 35 U.S.C. 154(b) by 312 days.

(21) Appl. No.: 12/383,590

(22) Filed: Mar. 25, 2009

(65) Prior Publication Data

US 2009/0255679 A1 Oct. 15, 2009

(30) Foreign Application Priority Data

Apr. 4, 2008 (GB) ..... 0806094.9

(51) Int. Cl.
*E21B 49/02* (2006.01)

(52) U.S. Cl. ..... 175/58; 166/332.8; 137/601.15; 251/242

(58) Field of Classification Search ..... 175/239–242, 175/233, 58; 166/318, 332.8; 251/219, 220, 251/231, 236, 242; 137/601.15, 601.2
See application file for complete search history.

(56) References Cited

U.S. PATENT DOCUMENTS 1,565,906 A * 12/1925 Clinton ..... 175/240
2,073,263 A * 3/1937 Hohmann et al. ..... 175/60
2,248,910 A * 7/1941 Auld et al. ..... 175/233
2,412,915 A * 12/1946 Sewell ..... 175/233
3,064,742 A * 11/1962 Bridwell ..... 175/226
3,833,074 A * 9/1974 Courtois ..... 175/87
4,142,594 A * 3/1979 Thompson et al. ..... 175/59
6,216,804 B1 * 4/2001 Aumann et al. ..... 175/236

OTHER PUBLICATIONS

Merriam-Webster Dictionary definition of "cam" accessed Apr. 20, 2011 via m-w.com.*

* cited by examiner

*Primary Examiner* — Jennifer H Gay
*Assistant Examiner* — Blake Michener
(74) *Attorney, Agent, or Firm* — Drinker Biddle & Reath LLP

(57) ABSTRACT

A selectively operable downhole valve for use with core sampling apparatus, the valve comprising a throughbore through which a first body may pass, and an obstructing member which is capable of selectively obturating the throughbore, the obstructing member being arranged to open or close the throughbore by movement of the first body with respect to the valve. A core sample of the formation may then be obtained and retrieved from the bore under pressure since the valve seals the bore downhole. Retrieving the sample under pressure maintains the integrity of the core sample so that subsequent analysis of the sample will more closely reflect the true characteristics of the formation.

15 Claims, 8 Drawing Sheets

VALVE, CORE SAMPLING APPARATUS AND METHOD

TECHNICAL FIELD

The present invention relates to a valve, core sampling apparatus and method, and more particularly, but not exclusively, relates to a core sampling apparatus using said valve and method for use in the oil and gas exploration industry.

BACKGROUND OF THE INVENTION

Core analysis is widely practised throughout the oil and gas exploration industry in order to determine various properties of the drilling formation. Analysis of the core generally involves removing the core from the formation and transporting it to the surface where it can subsequently be analysed. In order to obtain accurate and useful information from the analysis, it is important that the properties of the core at the surface are an accurate representation of the core properties downhole. In order to maintain core property measurements representative of the downhole conditions, it is important that, during removal to the surface, the surrounding pressure of the core sample is maintained at a pressure which is high enough to prevent any fluid present in the sample from escaping and thereby damaging the sample. Accordingly, it would be desirable to be able to retain the fluids within the sample.

Current methods of extracting the sample from the downhole environment at relatively high pressure involve passing the core sample into an inner barrel (whilst downhole) which has a pressure valve at each end. Once the core sample has entered the inner barrel, the pressure valves are actuated in order to seal in the core sample at the surrounding downhole pressure. The inner barrel is then retrieved to the surface of the well and the highly pressurised (relative to the outside surface ambient pressure or atmospheric pressure) inner barrel is removed for analysis. This method has the disadvantage of being dangerous to persons operating the well since there exists the possibility of the high pressure, thin walled inner barrel exploding, thereby causing serious injury.

SUMMARY OF THE INVENTION

According to the first aspect of the present invention there is provided a selectively operable downhole valve for use with core sampling apparatus, the valve comprising a throughbore through which a first body may pass, and an obstructing member which is capable of selectively obturating the throughbore, the obstructing member being arranged to open or close the throughbore by movement of the first body with respect to the valve.

According to a second aspect of the present invention there is also provided a method of selectively operating a downhole valve comprising the steps of:

passing a first member through a throughbore of the downhole valve, the downhole valve comprising a throughbore obstructing member; and opening or closing the throughbore by movement of the first member with respect to the valve.

Preferably, the method of the second aspect further comprises the step of maintaining one side of the obturated valve at a higher pressure relative to the other side. More preferably, the said one side is the uppermost face of the downhole valve and the said other side is the lowermost face of the downhole valve.

According to a third aspect of the present invention there is provided a method of obtaining a core sample from downhole, the method comprising:

inserting a first member into a tubular string and providing for passage of the first member through a selectively operable downhole valve;

permitting a core to be sampled to move into, and be held within, the first member;

retrieving the first member back to surface from downhole; and characterised in that when the first member is withdrawn back through the downhole valve, the downhole valve is closed and the throughbore of the string of tubulars above the downhole valve is pressurised.

Typically, the method according to the third aspect further comprises providing the valve with a throughbore through which a first body may pass, and an obstructing member which is capable of selectively obturating the throughbore, the obstructing member being arranged to open or close the throughbore by movement of the first body with respect to the valve.

Typically, the downhole valve is incorporated into the tubular string which is run into the hole in a first step. Preferably, the first member is provided with a first portion of a retrieval mechanism and the first member is typically retrieved by running a second portion of a retrieval mechanism into the throughbore of the tubular string by an elongate member such as wireline until the first and second portions of the retrieval mechanisms engage and paying in the elongate member back to surface. Typically, the first member is retrieved to surface through the tubular string under pressure and is delivered into pressure retaining equipment at surface.

Preferably, the obstructing member is biased into the obstructing position and more preferably is adapted to substantially remain in its obstructing position when a fluid pressure differential is applied across it such that fluid is typically prohibited from flowing through the valve. Typically, therefore, the obstructing position is essentially a closed position.

Preferably, the valve is provided with a by-pass device adapted to allow fluid to flow through the valve when the pressure differential across the valve is at or exceeds a predetermined level when the obstructing member is in its obstructing position.

Preferably, the by-pass device comprises an annular portion having flow apertures which are typically in fluid communication with a pressure relief device.

Preferably, the annular portion has an inner diameter of greater diameter than the outer diameter of the first body.

Preferably, the pressure relief device comprises a sealing mechanism held against one or more outlets of the flow apertures by a resilient member. More preferably the resilient member is a spring mechanism.

Preferably, the obstructing member comprises a flap member which has a cross sectional area substantially similar to the cross sectional area of the throughbore of the downhole valve. More preferably, the flap member is provided with a hinged connection.

Preferably, the hinged flap member is adapted to open or close the throughbore of the downhole valve by hinging toward the opposite direction to the direction of movement of the first member.

Preferably, the downhole valve further comprises sensing mechanism which is preferably adapted to sense the presence of the first member at or near the valve.

Preferably, the sensing mechanism comprises a cammed surface partially protruding into the throughbore of the downhole valve.

Preferably, the downhole valve further comprises actuation mechanism, typically in communication with the sensing mechanism and the obstructing member. More preferably, the actuation mechanism comprises a lever connecting the sensing mechanism to the obstructing member.

Preferably, the valve comprises a guiding block adapted to guide the first member through the throughbore via the sensing mechanism.

Preferably, the guide block comprises a guide member having an inlet of greater diameter than its outlet.

Typically, the guide member comprises apertures which allow fluid to flow from one side of the guide block, which may be an external side of the guide block, to the throughbore of the downhole valve on the other side of the guide block, and preferably the apertures allow such fluid to flow whether the first body is present or not present in the guide member.

Preferably, the obstructing member is held in the obstructing position by resilient holding mechanism. More preferably, the resilient holding mechanism is a spring.

Preferably, the first body is the inner barrel of a coring assembly.

BRIEF DESCRIPTION OF THE DRAWINGS

Embodiments of the present invention will now be described, by way of example only, with reference to the accompanying drawings, in which.

DESCRIPTION OF THE PREFERRED EMBODIMENTS

Figure 2:
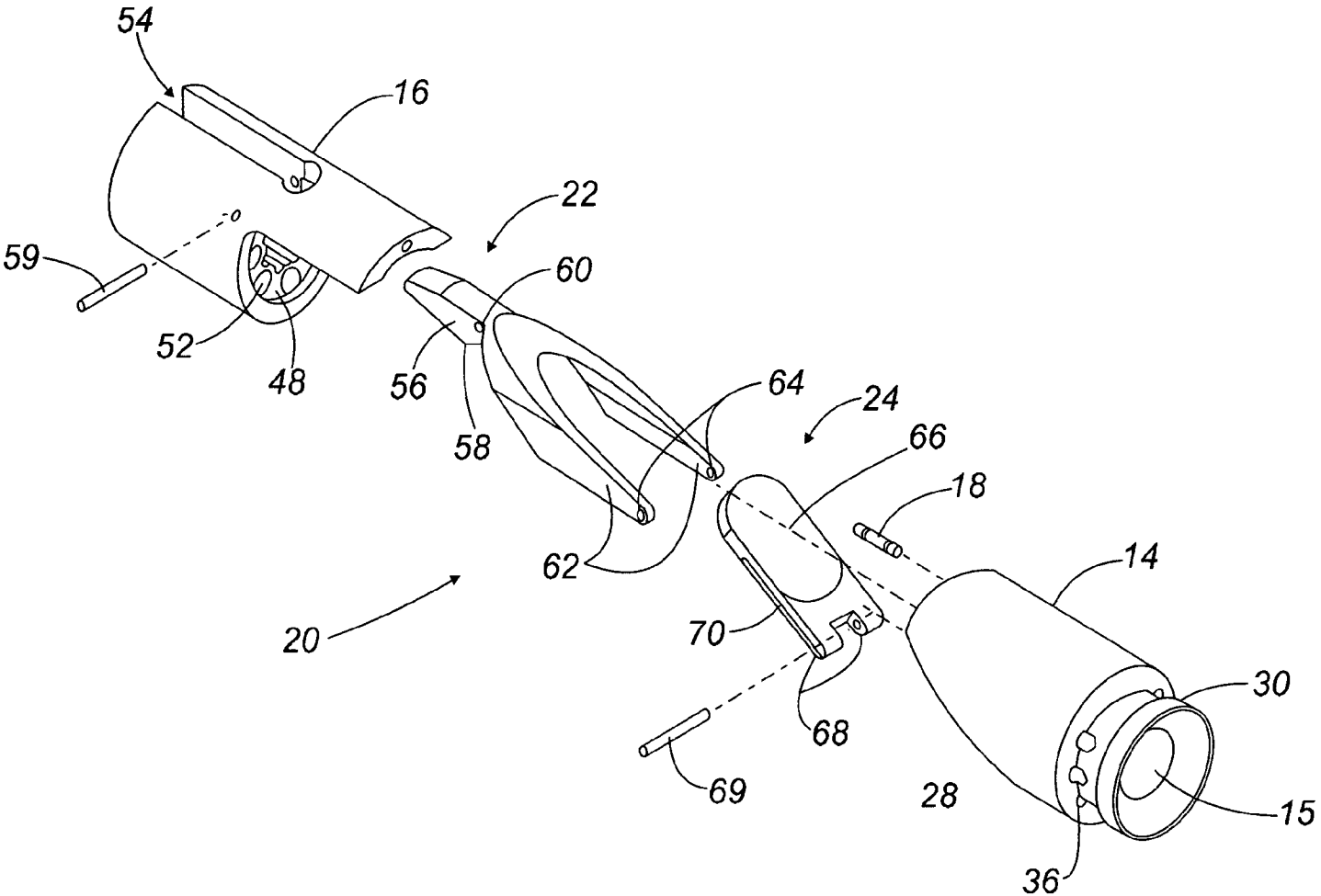
FIG. 2 is an exploded isometric view showing the components of the apparatus of FIG. 1.
Figure 5:
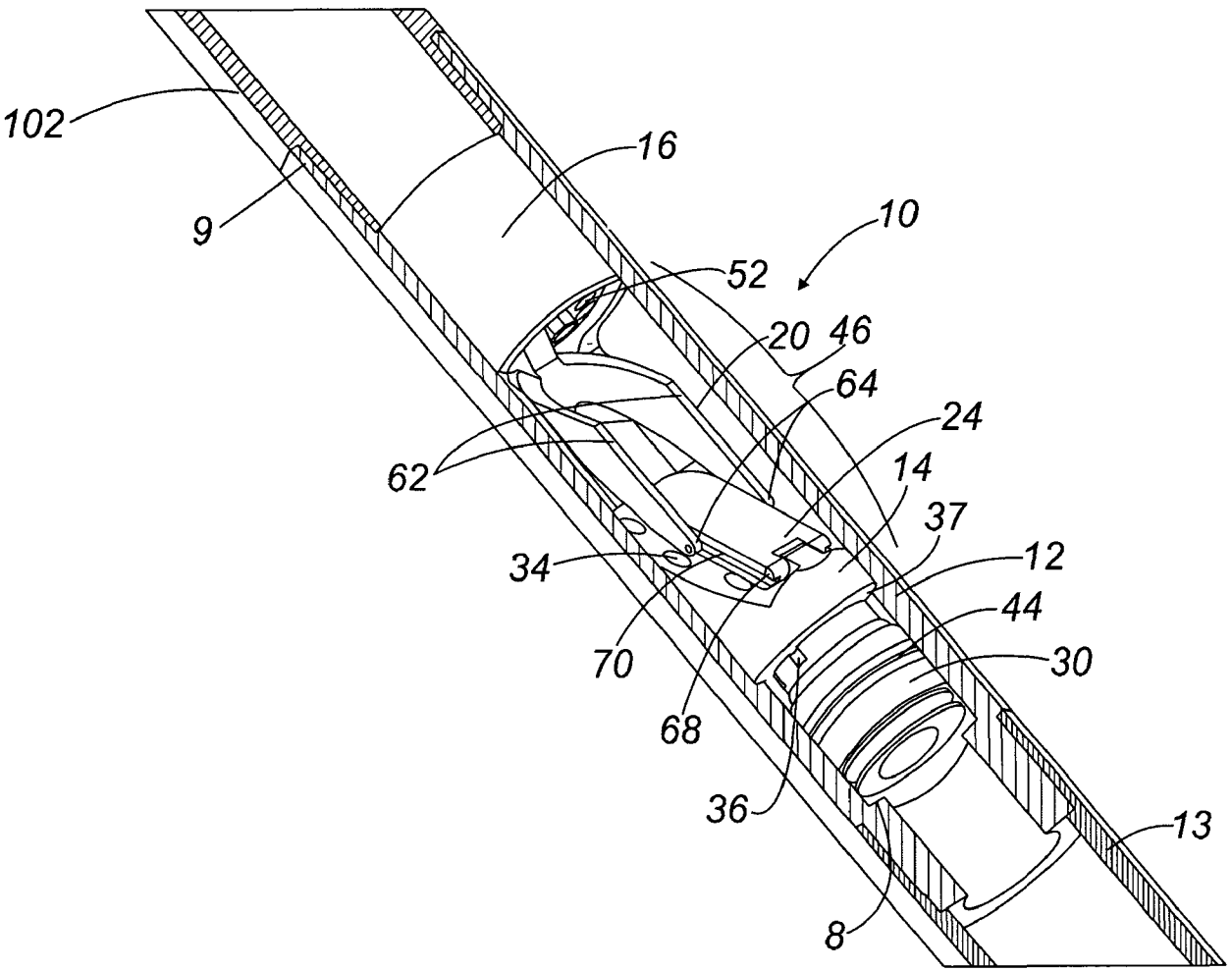
FIG. 5 is a schematic cut away view of the apparatus of FIG. 1 in position downhole.

An apparatus in accordance with the present invention is shown in FIG. 5 in the form of a flap valve apparatus 10 which is positioned in an outer housing 12 of a tubular string such as a core barrel 13 between a pair of radially inwardly projecting shoulders 9 and 37 as shown in FIG. 2, the main body of the flap valve apparatus 10 comprises a lower substantially tubular body section 14 having a throughbore 15 connected to an upper substantially tubular body section 16 by a connecting pin 18. The lower and upper body sections 14, 16 in use are located within an outer housing 12. The apparatus 10 comprises a valve mechanism 20 between the lower and upper body sections 14, 16 and the valve mechanism 20 comprises a lever fork 22 and a flap 24.

Figure 1:
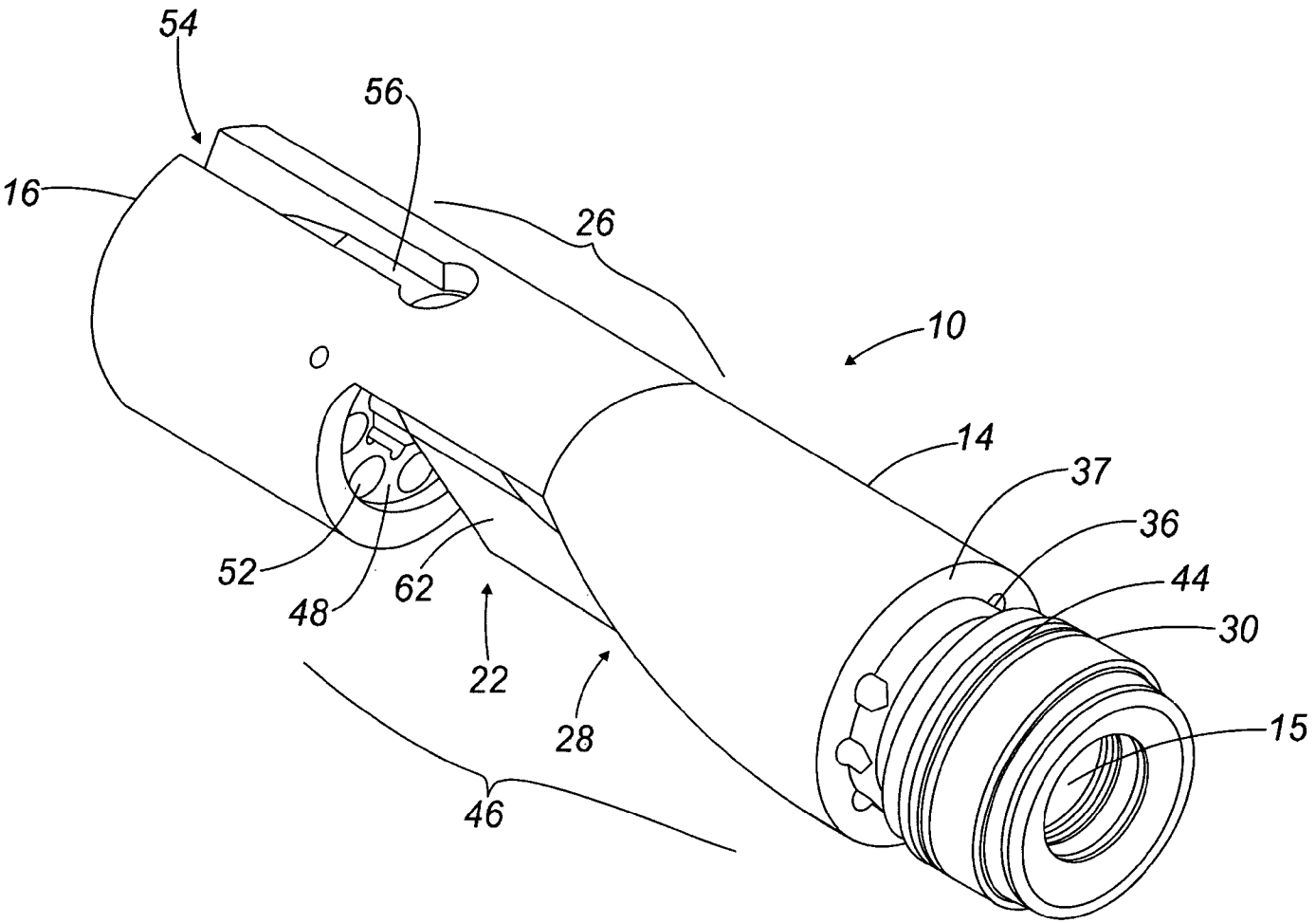
FIG. 1 is an isometric view of the apparatus according to the present invention.

As shown in FIG. 1, the lower body section 14 is tapered at 28 toward the longitudinal centre of the apparatus 10. The upper substantially tubular body section 16 has a portion cut-away and so has a partially tubular extension 26, extending in the direction of the longitudinal axis of the section 16 which provides a connection point to the lower section 14. The cut away portion and tapered portion 28 together create a cavity 46 throughbore Best shown in FIG. 2, the lever fork 22 of the valve mechanism 20 comprises an actuating cam 56 having a contact point 58 and a pivot point 60 provided by pivot pin 59. The actuating cam 56 is connected to a pair of lever arms 62 which each comprise flap pivot points 64 at their lowermost ends.

The flap 24 of the valve mechanism 20 consists of a planar oval member 66 having pivot points 68 provided by pivot pin 69 and slotted guide rails 70.

Figure 6:
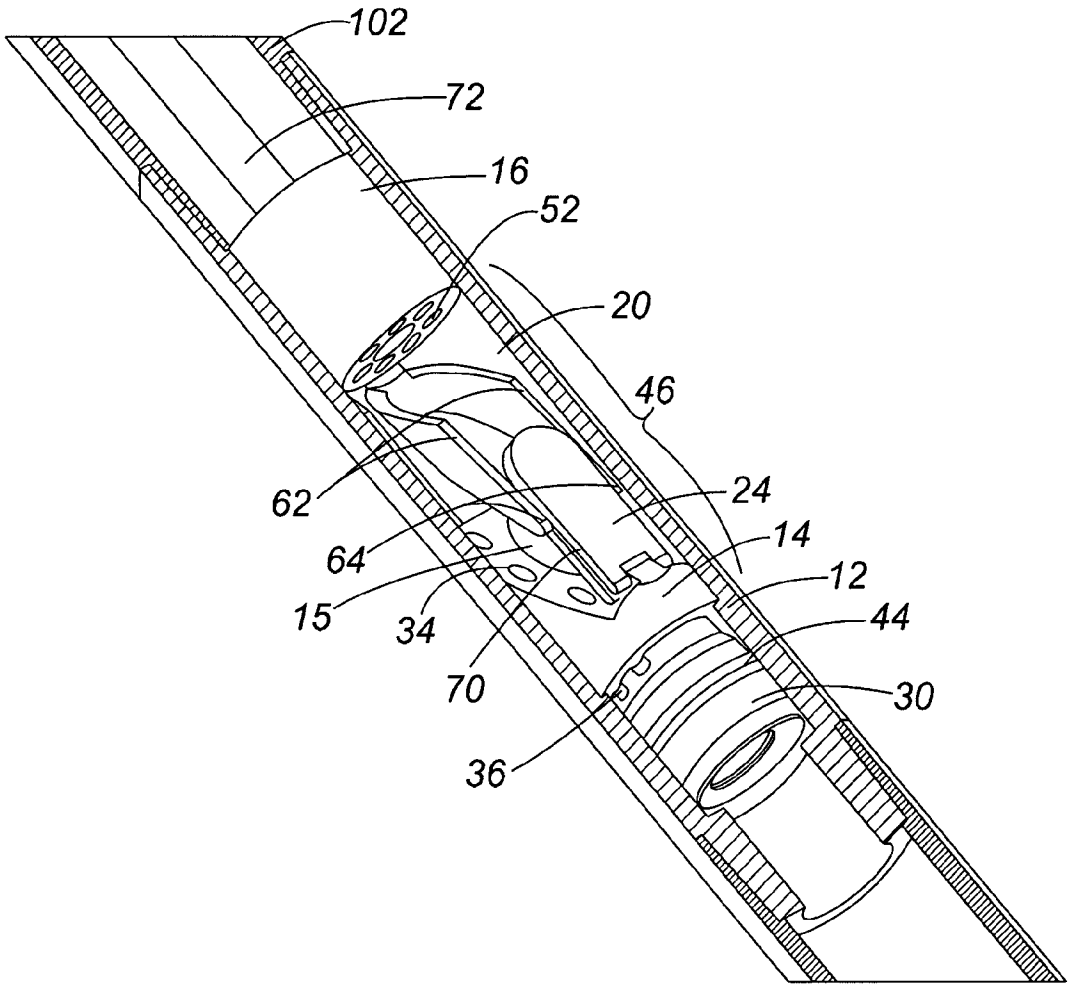
FIG. 6 is a schematic cut away view of the apparatus of FIG. 5 as an inner barrel arrives at the apparatus.
Figure 7:
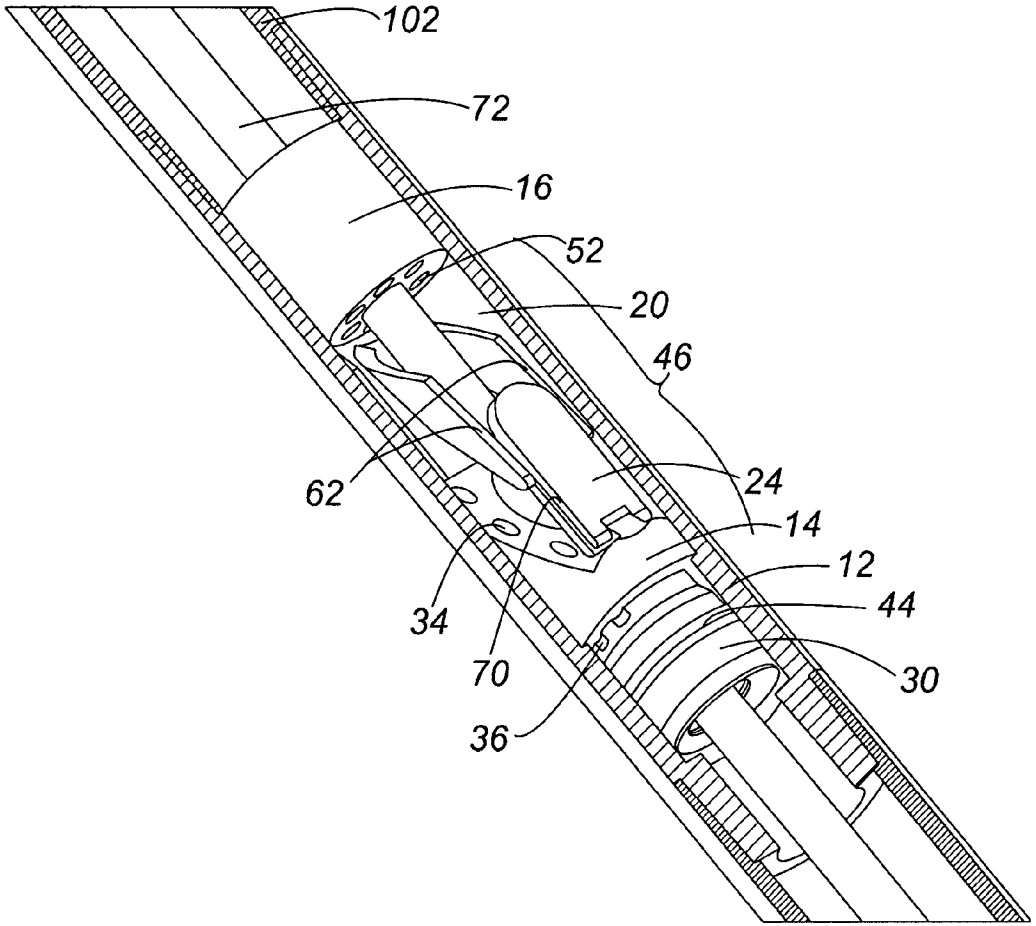
FIG. 7 is a schematic cut away view of the apparatus of FIG. 6 as the inner barrel passes through the apparatus.
Figure 9A:
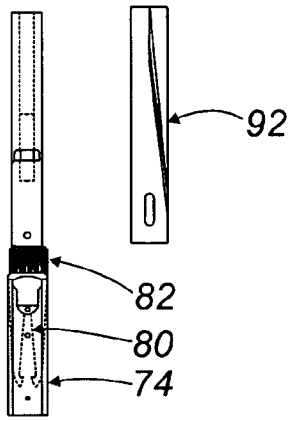
FIGS. 9A and 9B are partial cross sectional views of the overshot device of FIGS. 8A to 8G and the inner barrel of FIG. 6.
Figure 9B:
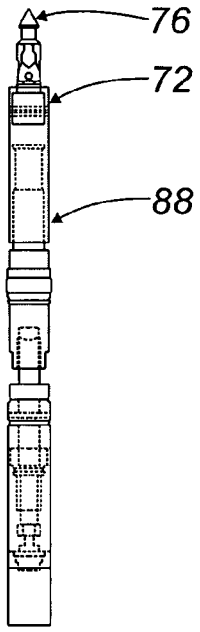
Figure 9C:
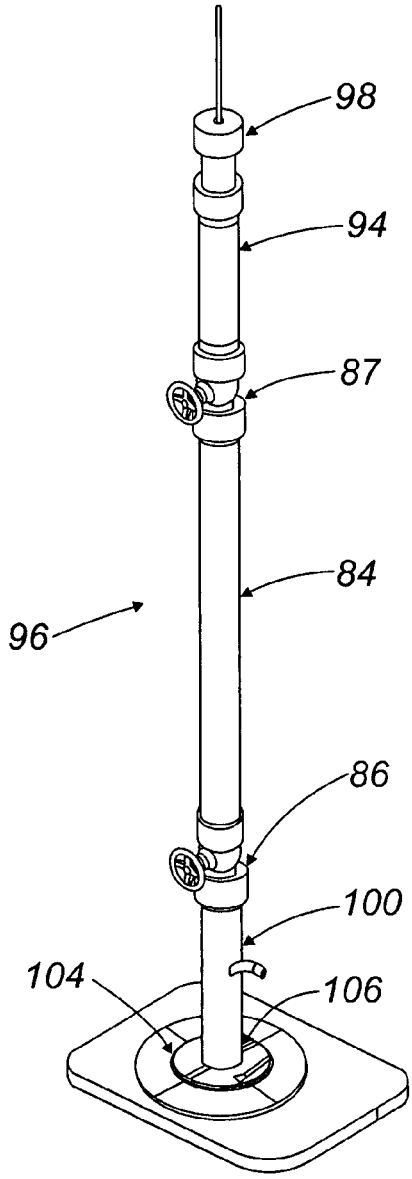
FIG. 9C is an isometric view of the on-rig recovery set-up used in conjunction with the apparatus of FIG. 1.

As shown in FIGS. 5 to 7, in use, the outer housing 12 is included, via conventional pin and box connections, in a string of tubulars having a core barrel 13 provided with a drill bit (not shown) at its lowermost end in the normal manner. The valve 10 is then inserted into the upper end of the outer housing 12 and is lowered until it comes to rest against the radially inwardly projecting shoulder 37. An upper portion of the coring barrel 102 is then screwed onto the upper end of the outer housing 12 and the coring string 13, 102 and thus the outer housing 12 is positioned downhole in the borehole of a well being drilled by lowering the coring string 13, 102 into the borehole by means of drill pipe 106 (shown in FIG. 9*c*).

Figures 8A, 8B, 8C, 8D, 8E, 8F, 8G:
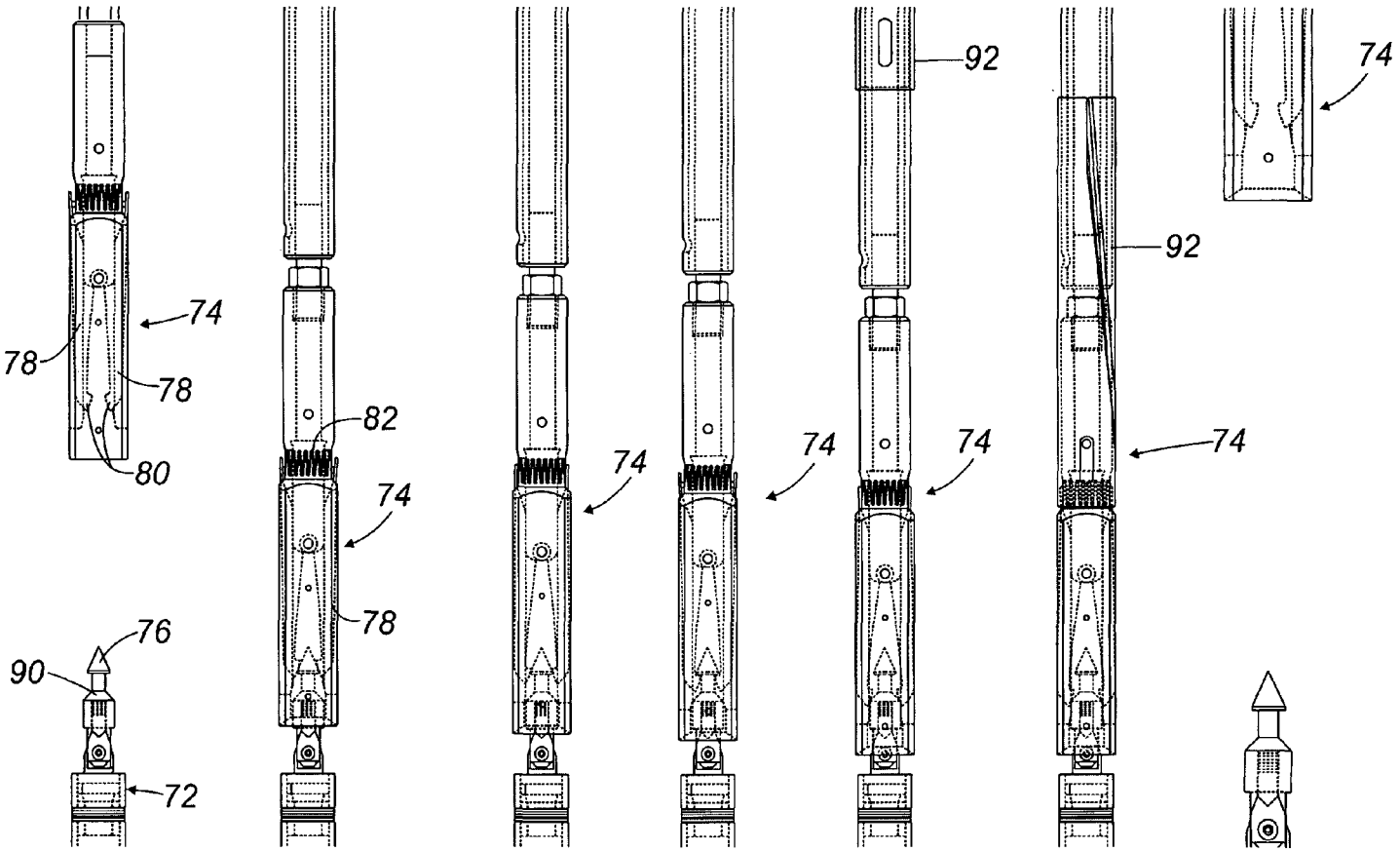
FIGS. 8A to 8G are schematic diagrams showing an overshot device which is used to pull the inner barrel of FIG. 7 out of the wellbore.

The flap 24 of the apparatus 10 will initially be in the closed position, as shown in FIG. 5. When the core sampling operation is to be performed, as shown in FIG. 8A, an inner barrel 72, having a spearhead 76 at its upper end, is dropped down the coring 102/drill string 106 from the drilling rig. The purpose of the spearhead 76 will be described subsequently. Upon reaching the internal surface of the guide member 48 of the apparatus 10, the inner barrel 72 progresses down the guide member 48 due to gravity. This is best shown in FIG. 6. Whilst passing through the guide member 48, the outer diameter of the inner barrel 72 abuts against actuating cam 56 at its contact point 58, thereby pushing the contact point 58, and hence the actuating cam 56 outwardly toward the wall of the upper tubular section 16. A longitudinal slot 54 provided in the wall of the tubular section 16 allows the actuating cam 56 room to actuate fully in this regard. As the actuating cam is moved outwardly by the presence of the inner barrel 72, it pivots around the pivot point 60 thereby moving the lever arms 62 away from the central axis of the apparatus 10. This outward movement of the lever arms 62 opens the flap 24 due to the flap pivot points 64 traversing along the guide rails 70, as indicated in FIG. 6. The inner barrel 72 is now free to pass through the throughbore 15 of the lower body section 14, thereby passing through the entire apparatus 10 as shown in FIG. 7.

In this way, the core sample can be collected in the inner barrel 72 in the normal way, by rotating the coring string 102 from surface via the drill pipe 106, such that the coring string 13 cuts into the formation and the sample moves into the inner barrel 72.

During operation of the coring assembly (not shown) it is normally necessary to circulate drilling mud through the well in order to move the core being cut into the inner barrel 72. The apparatus 10 allows the drilling mud to flow through the upper body section 16 when the inner barrel 72 is in place by the provision of a guide member 48 having an internally tapered guide 50 and flow holes 52 provided in the throughbore of body section 16. The flow holes 52 allow the drilling mud to flow from the annulus between the inner barrel 72 and the outer housing 12 and into the cavity 46. The drilling mud may then pass from the cavity 46 through the annulus created between the outer diameter of the inner barrel 72 and the inner diameter of the throughbore 15 (which is substantially larger than that of the inner barrel 72) of the lower body section 14. (Note the flap 24 will be in the open position due to the presence of the inner barrel 72 in the upper body section 16).

When the core sample is to be brought to the surface, the inner barrel 72 is retracted (by means of the overshot device 74 as will be described subsequently) past the guide member 48. The removal of the inner barrel 72 from the guide member 48 permits the flap 24 to close due to the action of a biasing mechanism in the form of a spring (not shown) provided on the pivot points 68 urging the flap 24 closed. This has the effect of immediately sealing off the inner bore of the apparatus 10 below the flap 24 from the inner bore of the apparatus 10 above the flap 24.

Sealing off the inner bore of the apparatus 10 in this way enables the upper section of the inner bore of the apparatus 10 (and thus the section of the inner bore of the coring/drill string above the apparatus 10) to be maintained at pressure by prohibiting dissipation of the pressure down the drill string 106 (which would normally happen if the apparatus 10, in particular closed flap 24, were not present). Since the apparatus 10 allows the upper section of the inner bore and thus the upper section of the coring barrel 102 and the drill string 106 to be maintained at a pressure value defined by the operator, the core sample pressure can be maintained as the sample is retrieved to the surface within the inner barrel 72. Maintaining the coring barrel 102 and drill string 106 pressure has the great advantage (over maintaining the inner barrel 72 alone at pressure) that it is much more capable of safely withstanding high pressure differentials, when compared with the inner barrel 72 alone. It should be noted that although the ambient downhole pressure acting on the formation can typically be very high, it is only necessary to maintain the pressure of the sample at a value which inhibits any gas present in the formation from reaching its bubbling point. In this regard it is believed that a pressure of approximately 60 bar may be generally sufficient.

Removal of the core sample, held within the inner barrel 72, to the surface for analysis is typically done using an overshot device or fishing tool 74 as shown in FIGS. 8A to 8G and FIGS. 9A and 9B. This is carried out by lowering the overshot 74 by wireline onto the inner barrel 72; for this purpose, the inner barrel is provided with a spearhead 76 at its upper end. The weight of the wireline and overshot 74 forces lifting dogs 78 on the overshot 74 onto the spearhead 76 by spreading the lifting dogs 78. The lifting dogs 78 have hooked ends 80 and when the cone of the spearhead passes the hooked ends 80 of the lifting dogs 78, the hooked ends 80 are locked onto the rear face of the spearhead cone 76 due to the action of return springs 82. The secure grip of the lifting dogs 78 on the spearhead 76 allows the inner barrel 72 to be lifted into the barrel housing 84 of an on rig recovery set-up 96 (shown in FIG. 9C).

The on rig recovery set-up 96 comprises a stuffing box 98, an overshot housing 94, an upper ball valve 87, a barrel housing 84, a lower ball valve 86, and a pump in sub 100 which are connected to the coring barrel 102, drill pipe string 106 and a rotary table 104 on the rig (not shown). Lifting the inner barrel 72 into the barrel housing 84 is performed by retracting the wireline through the stuffing box 98 until the lower end of the inner barrel 72 has passed the lower ball valve 86 on the recovery set-up 96. The lower ball valve 86 is then closed and the locking dogs 78 are allowed to rest on a secondary cone 90 of the spearhead 76. This spreads the locking dogs 78 further apart as shown in FIGS. 8E and 8F. A locking sleeve 92 (FIGS. 8E and 8F) is then dropped onto the overshot 74 thereby locking the lifting dogs 78 in the wide opened position. The overshot 74 and locking sleeve 92 are then lifted into the overshot housing 94 by the wireline, through the stuffing box 98, leaving behind the inner barrel 72 in the barrel housing 84 of the recovery set-up 96. The upper ball valve 87 is then closed.

The barrel housing 84, containing the inner barrel 72 and core sample, can then be removed from between the upper and lower ball valves 87, 86 for analysis.

Figure 4:
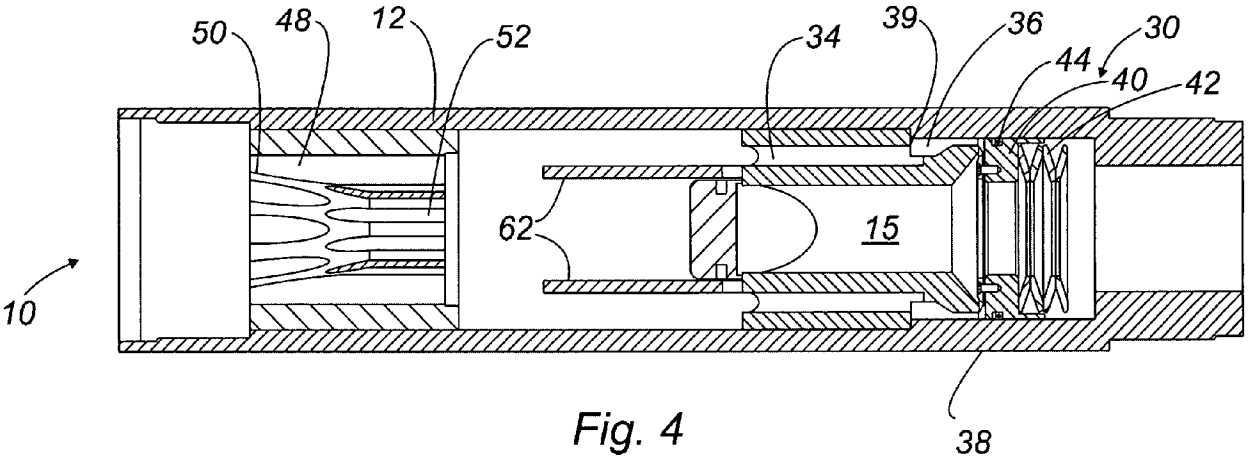
FIG. 4 is cross sectional view of the apparatus taken through the line A-A of FIG. 3.
Figure 3:
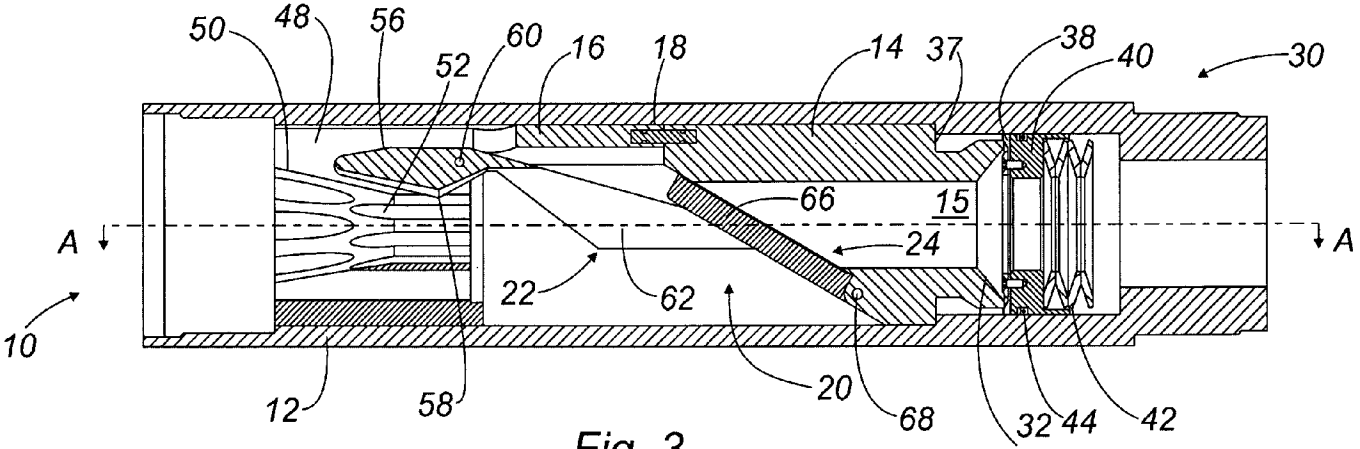
FIG. 3 is a cross sectional view of the apparatus of FIG. 1.

During coring operations it is important to be able to circulate drilling mud, with very little notice, in the event of an emergency. This may be necessary when the apparatus 10 is in position downhole but the inner barrel 72 has not yet been dropped down the inner bore of the coring/drill string. As described previously, when the inner barrel 72 is not present in the apparatus 10, the flap 24 will not be open and the drilling mud will be prohibited from flowing down the inner bore of the coring/drill string. This problem is tackled by the provision of the safety valve arrangement 30 located within the outer housing 12 immediately below the lower end of body section 14 in line with an outlet 32 of section 14. As shown in FIG. 4, a number of bypass flow holes 34 are equi-spaced around the outer circumference of the lower section 14 and run from the tapered surface 28 (not shown in FIG. 4) of section 14 toward an annular channel 36 formed around the lower end of the body section 14. The safety valve arrangement 30 (not labelled in FIGS. 3 and 4) includes an annular seal 38, the upper face (left hand side in FIGS. 3 and 4) of which is in fluid communication with the annular channel 36. The lower face of the seal 38 abuts against an annular seal seat 40 which in turn abuts against a biasing mechanism in the form of disc springs 42. An 'O' ring 44 is located in a groove formed around the circumference of the seal seat 40 such that the 'O' ring 44 provides a seal between the seal seat 40 and the inner wall of the outer housing 12.

As the differential pressure of the drilling mud is increased across the upper and lower section of the outer housing 12, the mud (which passes through the flow holes 34 on the lower body section 16) pressure is exerted on the upper face of the annular seal 38 which in turn transfers this pressure to the annular seal seat 40. The disc springs 42 are compressed due to the force being exerted upon them and the annular seal and seat 38, 40 are displaced away from the outlet 32 of the lower body section 14. The displacement of the seal 38 away from the outlet 32 creates a small gap (not shown) between the seal 38 and the outlet 32 which allows the high pressure drilling mud present in the upper section of the outer housing 12 to flow into the lower section of the outer housing 12. When the differential pressure is allowed to drop again, the spring urges the seal 38 back against the outlet 32, thereby sealing off the upper and lower section of the outer housing 12. In this way the safety valve arrangement allows drilling mud to flow through the apparatus 10, in an emergency even if the inner barrel 72 is not present, without having to remove the apparatus 10 to the surface for servicing once the safety valve arrangement has been utilised.

Modifications and improvements may be made to the foregoing without departing from the scope of the present invention.

We claim:

1. A selectively operable downhole valve positioned within a core sampling apparatus, the core sampling apparatus having an inner barrel, the valve comprising:

a throughbore through which the inner barrel of the core sampling apparatus may pass;

an obstructing member for selectively obturating the throughbore;

a sensing mechanism comprising a cammed surface partially protruding into the throughbore of the downhole valve; and an actuation mechanism comprising a lever having a first pivot axis, the lever connecting the sensing mechanism to the obstructing member;

whereby the actuation mechanism is configured such that movement of the inner barrel of the core sampling apparatus through the throughbore moves the cammed surface radially with respect to the throughbore, thereby moving the lever around the first pivot axis and initiating movement of the obstructing member, the lever being pivotally connected to the obstructing member at a second pivot axis which is moveable relative to the obstructing member being arranged as the obstructing member moves to open or close the throughbore.

2. A valve as claimed in claim 1, wherein the obstructing member is biased into the obstructing position.

3. A valve as claimed in claim 1, wherein the sensing mechanism is adapted to sense the presence of the inner barrel at or near the valve.

4. A valve as claimed in claim 3, comprising a guide member configured to receive the inner barrel, the guide member including apertures configured to allow fluid to flow through guide member to the throughbore of the downhole valve, when the inner barrel is present in the guide member.

5. A valve as claimed in claim 1, comprising a by-pass device configured to allow fluid to flow through the valve when the pressure differential across the valve is at or exceeds a predetermined level when the obstructing member is in its obstructing position.

6. A valve as claimed in claim 5, wherein the by-pass device comprises an annular portion having flow apertures which are in fluid communication with a pressure relief device.

7. A valve as claimed in claim 1, wherein the throughbore of the valve has an inner diameter of greater diameter than the outer diameter of the inner barrel.

8. A valve as claimed in claim 1, wherein the obstructing member comprises a flap having a cross-sectional area substantially similar to the cross sectional area of the throughbore of the valve.

9. A valve as claimed in claim 8, wherein the flap comprises a planar oval member hingedly connected to the valve to open and close the throughbore in the valve, and wherein the flap is connected to the lever at the second pivot axis on the flap wherein the second pivot axis translates along a guide rail on the flap while the flap is pivoting around the first pivot axis.

10. A valve as claimed in claim 1, wherein the lever is in the form of a fork having a first end incorporating the actuating cam, and a forked second end having two lever arms extending on different sides of the obstructing member, the lever arms being connected to the obstructing member via two second pivot axes on the obstructing member, and wherein the first pivot axis is a fulcrum about which the lever pivots, wherein the fulcrum is located between the first and second ends.

11. A valve as claimed in claim 10, wherein the lever arms have free ends and are pivotally connected to the obstructing member at two second pivot axes at their free ends.

12. A method of obtaining a core sample from a downhole borehole, the method comprising:

providing a core sampling apparatus for obtaining the core sample, the core sampling apparatus having an inner barrel;

inserting the inner barrel of the core sampling apparatus into a throughbore of downhole valve;

permitting a core to move into, and be held within, the inner barrel;

retrieving the inner barrel back to surface from downhole; wherein the valve comprises:

an obstructing member for selectively obturating the throughbore;

a sensing mechanism comprising a cammed surface partially protruding into the throughbore of the downhole valve; and an actuation mechanism comprising a lever having a first pivot axis, the lever connecting the sensing mechanism to the obstructing member;

wherein the movement of the inner barrel of the core sampling apparatus through the throughbore moves the cammed surface radially with respect to the throughbore, and thereby moves the lever around the first pivot axis and initiates movement of the obstructing member, the lever being pivotally connected to the obstructing member at a second pivot axis which moves relative to the obstructing member as the obstructing member moves to open or close the throughbore.

13. A method as claimed in claim 12, configured such that when the inner barrel is retrieved back to surface, the downhole valve is closed and the throughbore of the tubular string above the downhole valve is pressurised.

14. A method as claimed in claim 12, wherein the obstructing member comprises a flap, the flap being hinged and configured to open the throughbore when the inner barrel moves in a direction away from the surface and into the throughbore of the valve and to close the throughbore when the inner barrel is retrieved back to surface by movement through the throughbore towards the surface, wherein the flap is constrained to move in the opposite direction to the direction of movement of the inner barrel.

15. A method as claimed in claim 12, configured such that the inner barrel is retrieved by running a second portion of a retrieval mechanism into the throughbore of the tubular string using an elongate member until the inner barrel and second portion of the retrieval mechanism engage, and paying in the elongate member back to surface.

* * * * *

UNITED STATES PATENT AND TRADEMARK OFFICE

CERTIFICATE OF CORRECTION

PATENT NO. : 8,122,976 B2
APPLICATION NO. : 12/383590
DATED : February 28, 2012
INVENTOR(S) : Pascal Bartette et al.

It is certified that error appears in the above-identified patent and that said Letters Patent is hereby corrected as shown below:

Claim 1, Col. 7, line 15, before "as the" delete "being arranged".

Claim 4, Col. 7, line 24, after "through" insert --the--.

Claim 12, Col. 8, line 13, after "of" insert --a--.

Signed and Sealed this
Eighth Day of May, 2012

David J. Kappos

David J. Kappos
*Director of the United States Patent and Trademark Office*